US008280269B2

(12) United States Patent
Yoshizumi

(10) Patent No.: US 8,280,269 B2
(45) Date of Patent: Oct. 2, 2012

(54) DEVELOPING CARTRIDGE THAT INCLUDES MEMBER TO BE PRESSED BY IMAGE-BEARING-MEMBER CARTRIDGE

(75) Inventor: Hikaru Yoshizumi, Handa (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 514 days.

(21) Appl. No.: 12/540,950

(22) Filed: Aug. 13, 2009

(65) Prior Publication Data

US 2010/0080610 A1 Apr. 1, 2010

(30) Foreign Application Priority Data

Sep. 26, 2008 (JP) ..... 2008-247373

(51) Int. Cl.
*G03G 15/10* (2006.01)
*G03G 21/16* (2006.01)

(52) U.S. Cl. ..... 399/61; 399/111

(58) Field of Classification Search ..... 399/61, 399/62, 64, 65, 24, 25, 27, 111, 113, 119, 399/120

See application file for complete search history.

(56) References Cited

U.S. PATENT DOCUMENTS 6,553,189 B2 4/2003 Miyamoto et al.
2007/0058993 A1 3/2007 Horinoe
2007/0196114 A1* 8/2007 Okabe ..... 399/13
2008/0181627 A1* 7/2008 Bae ..... 399/27
2008/0219686 A1 9/2008 Yamagata

FOREIGN PATENT DOCUMENTS

JP 2002-123078 4/2002
JP 2002-123079 4/2002
JP 2005-266068 9/2005
JP 2007-79121 3/2007
JP 2008-51879 3/2008

OTHER PUBLICATIONS

Japanese Official Action dated Aug. 24, 2010 with English language translation.

* cited by examiner

*Primary Examiner* — Walter L Lindsay, Jr.
*Assistant Examiner* — Billy J Lactaoen
(74) *Attorney, Agent, or Firm* — Scully, Scott, Murphy & Presser, PC

(57) ABSTRACT

A process cartridge includes an image bearing member cartridge and a developing cartridge detachably installed in the image bearing member cartridge. The image bearing member cartridge has a pair of first and second side plates, a latent image bearing member, and a pressure member. The developing cartridge has a pair of third and fourth side plates and a pair of first and second light guides fixed at the third and fourth side plates, respectively. The pressure member presses side surfaces of the first and the second light guides, thereby urging the developing agent bearing member toward the latent image bearing member.

17 Claims, 13 Drawing Sheets

DEVELOPING CARTRIDGE THAT INCLUDES MEMBER TO BE PRESSED BY IMAGE-BEARING-MEMBER CARTRIDGE

CROSS REFERENCE TO RELATED APPLICATION

This application claims priority from Japanese Patent Application No. 2008-247373 filed Sep. 26, 2008. The entire content of the priority application is incorporated herein by reference.

TECHNICAL FIELD

The present invention relates to an image forming device, and more particularly to an image forming device using a process cartridge.

BACKGROUND

Electrophotographic image forming devices typically use a process cartridge that is detachably mounted in the image forming device. One example of the process cartridge includes a drum cartridge incorporating a photosensitive drum therein, and a developing cartridge detachably mounted on the drum cartridge. The developing cartridge includes a developing roller that is urged toward the photosensitive drum by a pressure member. The developing cartridge further includes a toner chamber that accommodates toner therein. To detect an amount of toner remaining in the toner chamber, a toner amount detector is provided to the image forming device.

This type of process cartridge is advantageous in terms of cost, because the drum cartridge and the developing cartridge can be separately and independently replaced with new one. However, such an image forming device is disadvantageous in some points. For example, space for accommodating a member to be pressed by the pressure member is limited.

SUMMARY

In view of the foregoing, it is an object of the present invention to provide an improved image forming device, wherein space for accommodating a member to be pressed by a pressure member is preserved.

In order to attain the above and other objects, the invention provides a process cartridge detachably installable to a main frame of an image forming device. The main frame has a developing-agent amount detection unit including a light emitting element and a light receiving element. The process cartridge includes an image bearing member cartridge and a developing cartridge. The image bearing member cartridge includes a first casing having a pair of first and second side plates defining an accommodation portion, a latent image bearing member having a surface on which an electrostatic latent image is formed, and a pressure member. The latent image bearing member is supported to the first casing. The developing cartridge is detachably installed in the accommodation portion and includes a second casing having a pair of third and fourth side plates in confrontation with the first and second side plates, respectively, a developing agent bearing member rotatably supported to the second casing, and a pair of first and second light guides fixed to the third and fourth side plates, respectively. The pair of third and fourth side plates defines a chamber that stores a developing agent. The developing agent bearing member supplies the developing agent onto the latent image bearing member. The pair of first and second light guides are configured to introduce a light emitted from the light emitting element into the chamber and to direct the light from the chamber toward the light receiving element. Each of the first and second light guides has a fixed end portion having a first end surface and fixed to either of the third and fourth side plates, a free end portion having a second end surface and remote from the chamber, and a side surface extending in an axial direction of the developing agent bearing member. The pressure member presses the side surfaces, thereby urging the developing agent bearing member toward the latent image bearing member.

There is also provided a developing cartridge detachably installable in an image bearing member cartridge including a pressure member. The developing cartridge includes a cartridge casing, a developing agent bearing member, and a pair of first and second light guides. The cartridge casing has a pair of first and second side plates defining a chamber that stores a developing agent. The developing agent bearing member bears the developing agent supplied from the chamber and is rotatably supported to the cartridge casing. The pair of first and second light guides are fixed to the first and second side plates, respectively. The pair of first and second light guides are configured to introduce a light into the chamber and directing the light from the chamber. The first light guide has a fixed end portion fixed to the first side plate and a free end portion remote from the chamber. The free end portion has an end surface and a side surface that the pressure member of the image bearing member cartridge presses.

Further, there is also provided a developing cartridge detachably installable in an image bearing member cartridge including a pressure member. The developing cartridge includes a cartridge casing, a developing agent bearing member, a gear transmission mechanism, and a pair of first and second light guides. The cartridge casing has a pair of first and second side plates defining a chamber that stores a developing agent. The developing agent bearing member bears the developing agent supplied from the chamber, and is rotatably supported to the cartridge casing. The gear transmission mechanism is provided at the first side plate and transmits a driving force to the developing agent bearing member. The pair of first and second light guides are fixed to the first and second side plates, respectively, made from a transparent material, and configured to introduce a light into the chamber and directing the light from the chamber. The pair of first and second light guides are positioned in symmetrical relationship with each other with respect to a plane extending in a direction perpendicular to an axial direction of the developing agent bearing member. The first light guide has a fixed end portion fixed to the first side plate and a free end portion remote from the chamber. The free end portion has an end surface and a side surface that the pressure member of the image bearing member cartridge presses. A distance between the first side plate and the end surface is greater than a distance between the first side plate and an outer contour of the gear transmission mechanism.

BRIEF DESCRIPTION OF THE DRAWINGS

In the drawings,

FIG. 12 is an illustrative horizontal cross-sectional view showing one of light guides according to the second embodiment of the invention in which depiction of a gear cover is dispensed with; and FIG. 13 is an illustrative horizontal cross-sectional view showing one of light guides according to a third embodiment of the invention in which depiction of a gear cover is dispensed with.

DETAILED DESCRIPTION

An image forming device according to a first embodiment of the present invention will be described with reference to FIGS. 1 through 10. The first embodiment pertains to a laser printer 1. The terms "upward", "downward", "upper", "lower", "above", "below", "right", "left", "front", "rear" and the like will be used throughout the description assuming that the laser printer 1 is disposed in an orientation in which it is intended to be used.

Figure 1:
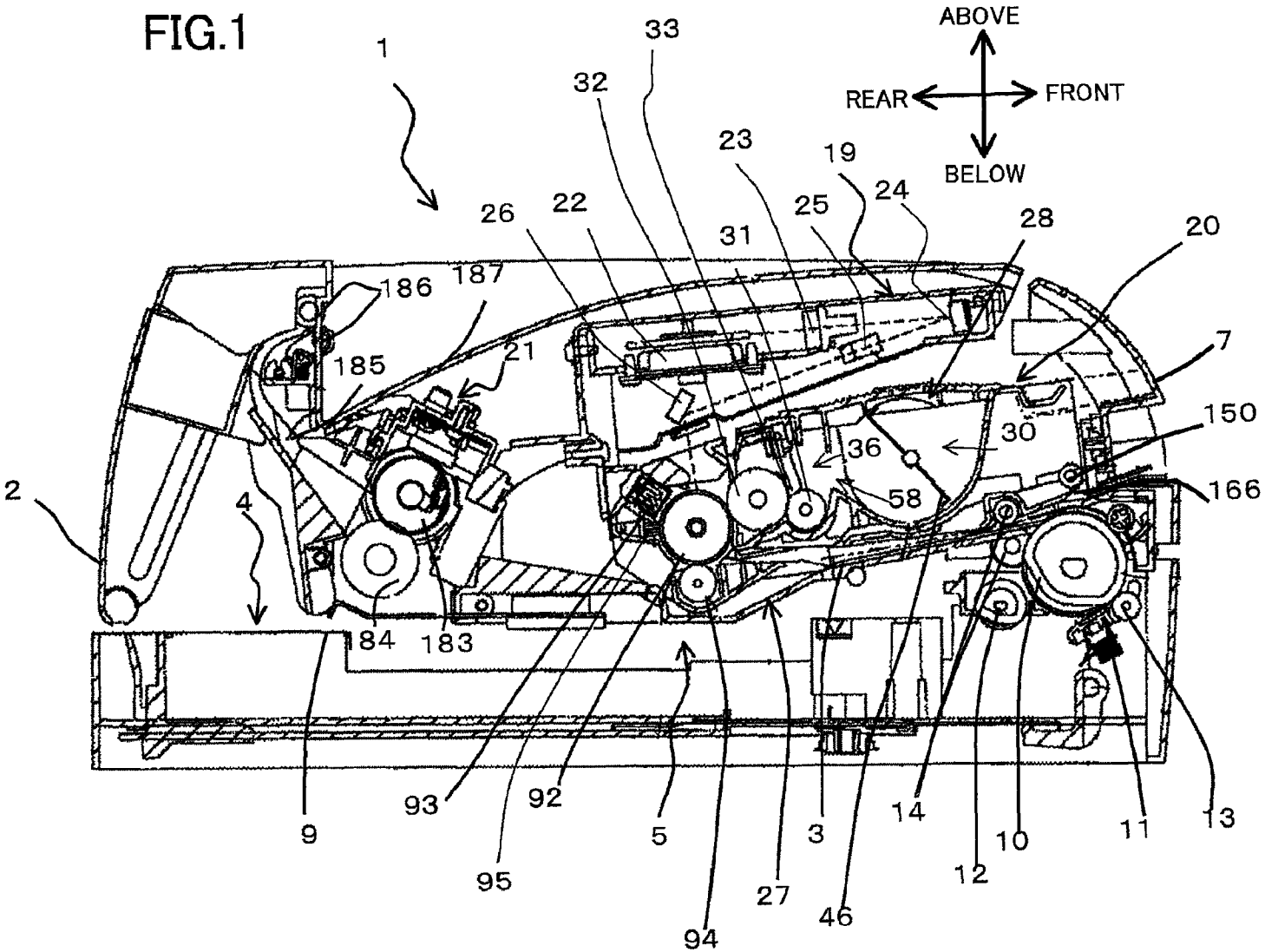
FIG. 1 is a vertical cross-sectional view showing a laser printer according to a first embodiment of the invention.

As shown in FIG. 1, the laser printer 1 has a main frame 2 in which a sheet supply section 4 for supplying a sheet 3 and an image forming section 5 for forming an image on the sheet 3 are provided. The main frame 2 has a front opening 6 (FIG. 2) for attachment and detachment of a process cartridge 20. A front door 7 is provided for opening and closing the front opening 6.

The sheet supply section 4 is provided in a lower portion of the main frame 2, and includes a sheet supply tray 9 and a sheet supply mechanism. The sheet supply tray 9 is detachably installed in the main frame 2 for accommodating therein a stack of cut sheets 3. The sheet supply mechanism includes a sheet supply roller 10, a separation pad 11, a pickup roller 12, a pinch roller 13, and a pair of registration rollers 14. The sheet supply roller 10 and the separation pad 11 are positioned above a front end portion of the sheet supply tray 9. The pickup roller 12 is positioned immediately rearward of the sheet supply roller 10. The pinch roller 13 is positioned immediately frontward of and lower than the sheet supply roller 10. The pair of registration rollers 14 are vertically arrayed at a position above and rearward of the sheet supply roller 10. Rotation of the pickup roller 12 feeds an uppermost sheet 3 in the sheet supply tray 9, and the sheet supply roller 10 and the separation pad 11 nip the sheet 3 therebetween for separating the uppermost sheet 3 from the remaining sheet stack. Then, the sheet 3 is supplied to the image forming section 5 by the pinch roller 13 and the pair of registration rollers 14.

The image forming section 5 includes a scanner unit 19, the process cartridge 20, and a fixing unit 21. The scanner unit 19 includes a polygon mirror 22, an fθ lens 23, a reflection mirrors 24, 26, and a lens 25. As shown by a broken line, a laser beam emitted from a laser light source (not shown) based on image data is deflected at the polygon mirror 22, passes through the fθ lens 23, is reflected at the reflection mirror 24, passes through the lens 25, is bent downward by the reflection mirror 26, and is irradiated onto a surface of a photosensitive drum 92 assembled to the process cartridge 20.

Figure 2:
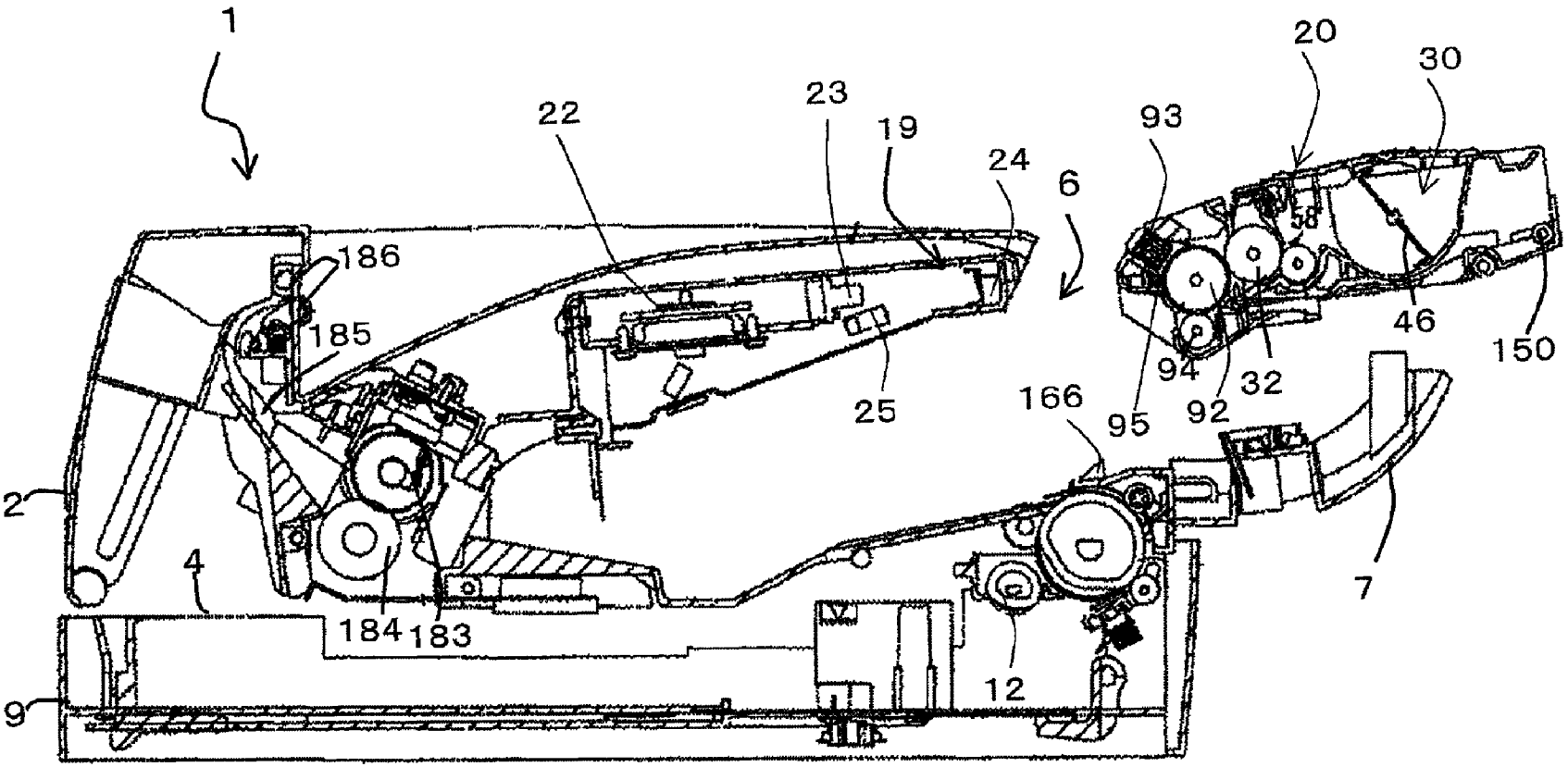
FIG. 2 is a vertical cross-sectional view showing mounting of a process cartridge to or dismounting the process cartridge from the laser printer.
Figure 3:
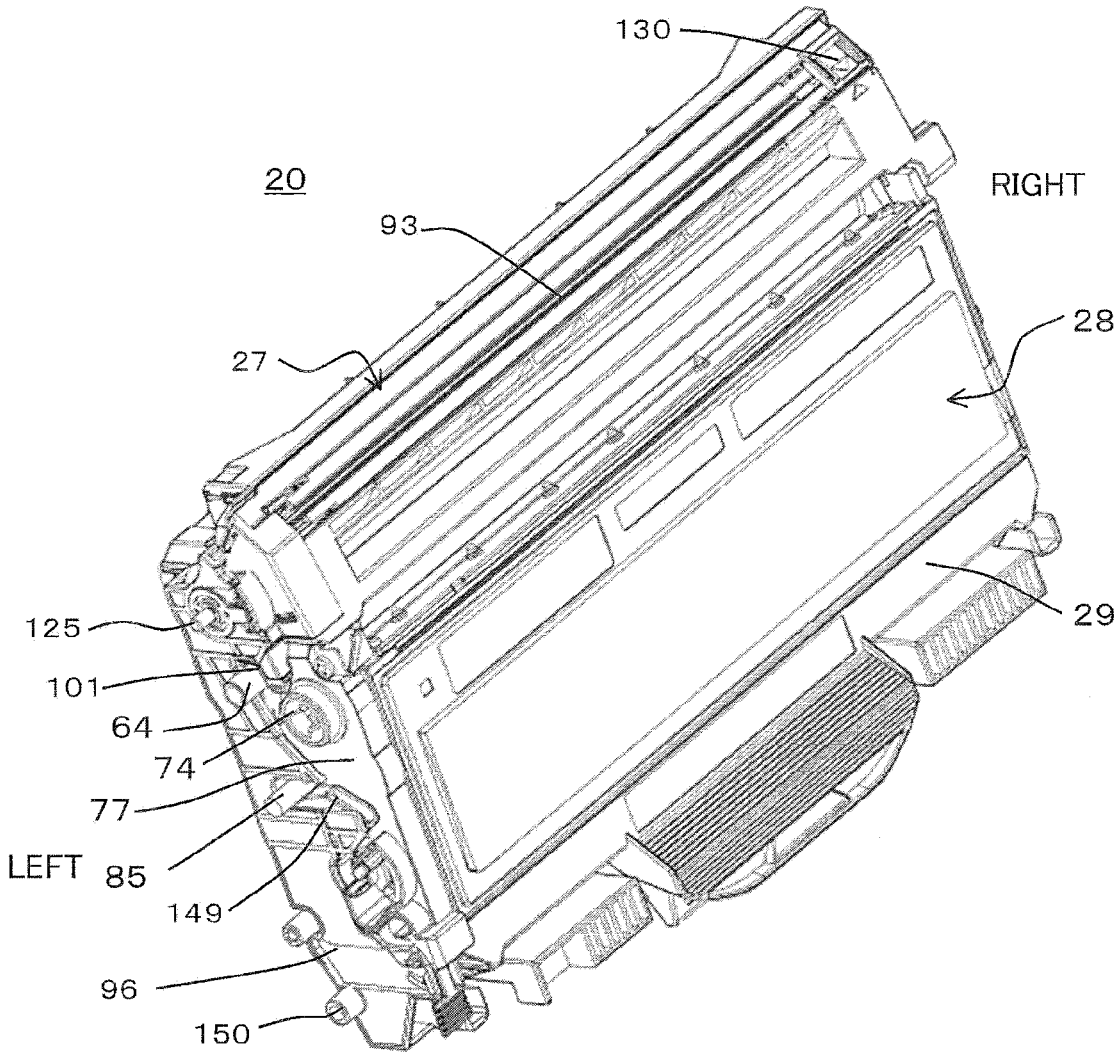
FIG. 3 is a perspective view showing the process cartridge.
Figure 4:
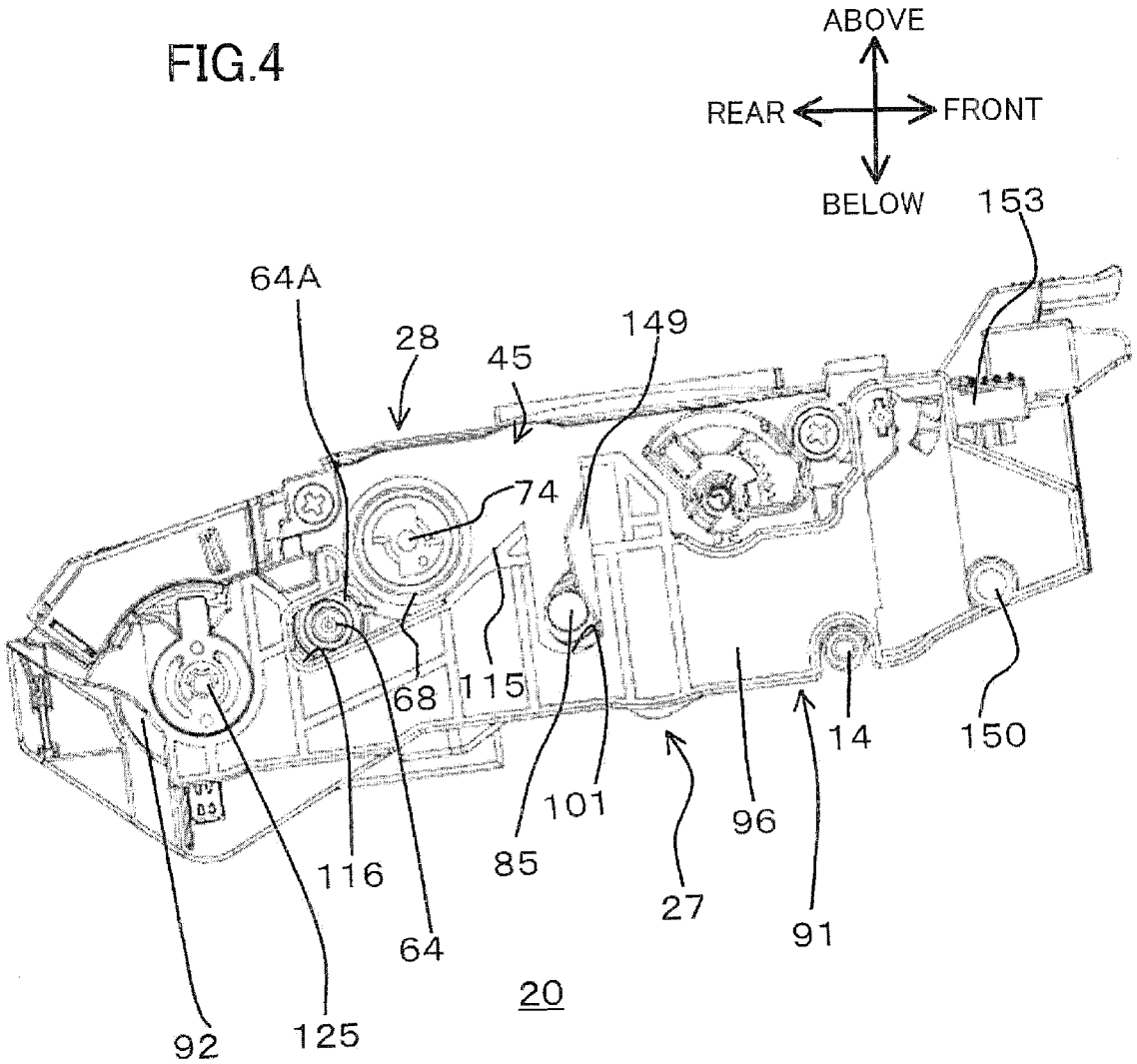
FIG. 4 is a left side view showing the process cartridge.
Figure 5:
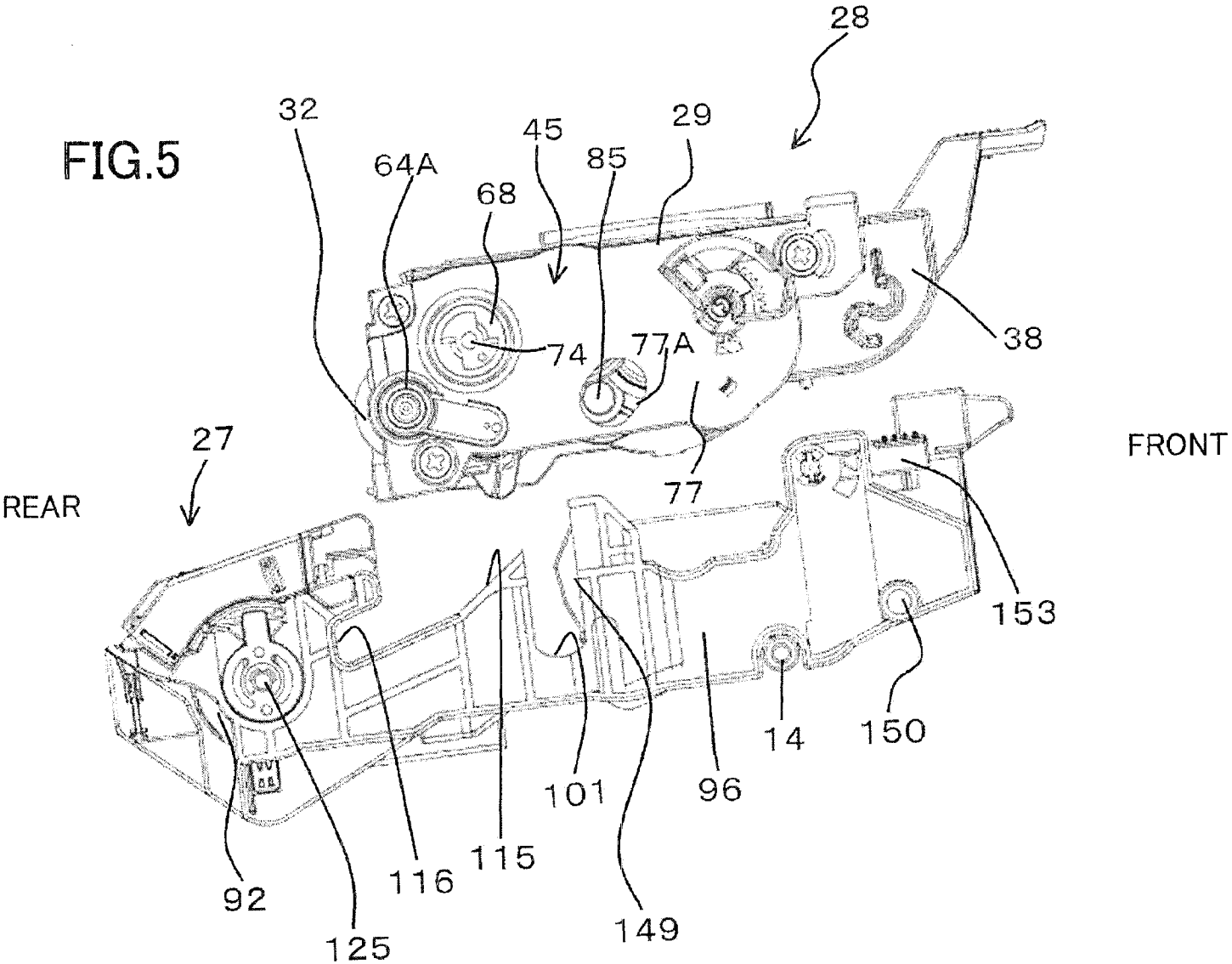
FIG. 5 is a vertical cross-sectional view showing mounting of a developing cartridge on or dismounting the developing cartridge from the process cartridge.

The process cartridge 20 is positioned below the scanner unit 19 and is detachably attached to the main frame 2 (FIG. 2). As shown in FIGS. 3 through 5, the process cartridge 20 includes a drum cartridge 27 and a developing cartridge 28 detachably attached to the drum cartridge 27.

The developing cartridge 28 can be detached from and attached to the main frame 2 integrally with the drum cartridge 27. Further, the developing cartridge 28 is detachable from and attachable to the main frame 2 while the drum cartridge 27 is installed in the main frame 2.

As shown in FIG. 1, the developing cartridge 28 is partitioned into a toner chamber 30 and a developing chamber 36. A toner supply port 58 is defined between the toner chamber 30 and the developing chamber 36. An agitator 46 is provided inside the toner chamber 30. Disposed inside the developing chamber 36 are a toner supply roller 31, a developing roller 32, and a blade 33. Toner accommodated in the toner chamber 30 is agitated by the agitator 46 and is discharged into the developing chamber 36 through the toner supply port 58. Then, the toner is supplied to the developing roller 32 by the rotation of the toner supply roller 31. At this time, the toner is triboelectrically charged with positive polarity between the toner supply roller 31 and the developing roller 32 to which a developing bias is applied.

The toner supplied onto the developing roller 32 is subjected to thickness regulation by the blade 33. Thus, a toner layer of uniform thickness is carried on the developing roller 32.

The drum cartridge 27 includes the photosensitive drum 92, a scorotron charger 93, a transfer roller 94, and a cleaning brush 95. The surface of the photosensitive drum 92 is uniformly charged with positive polarity by the scorotron charger 93 while the photosensitive drum 92 rotates. Then, the surface is exposed to a high-speed scanning of laser beam from the scanner unit 19 to form an electrostatic latent image on the surface. A visible toner image corresponding to the latent image is formed on the surface of the photosensitive drum 92 by supplying positively charged toner from the developing roller 32.

The toner image carried on the surface of the photosensitive drum 92 is transferred to the sheet 3 by the transfer bias applied to the transfer roller 94 when the sheet 3 passes between the photosensitive drum 92 and the transfer roller 94. Paper dust transferred from the sheet 3 to the photosensitive drum 92 can be removed by the cleaning brush 95 applied with cleaning bias.

The fixing unit 21 includes a heat roller 183 and a pressure roller 184 for thermally fixing the toner image onto the sheet 3 while the sheet 3 passes between the heat roller 183 and the pressure roller 184. The sheet 3 with the toner image fixed thereon is conveyed along a discharge path 185 that diagonally upwardly extends from the fixing unit 21, and is discharged by discharge rollers 186 onto a discharge tray 187 formed at an upper surface of the main frame 2.

Next, the developing cartridge 28 will be described in detail. As shown in FIG. 5, the developing cartridge 28 includes a developing cartridge casing 29 made from a resin such as a polystyrene. In the developing cartridge casing 29, the developing chamber 36 and the toner chamber 30 shown in FIG. 1 are arrayed in the front-to-rear direction.

Figure 6:
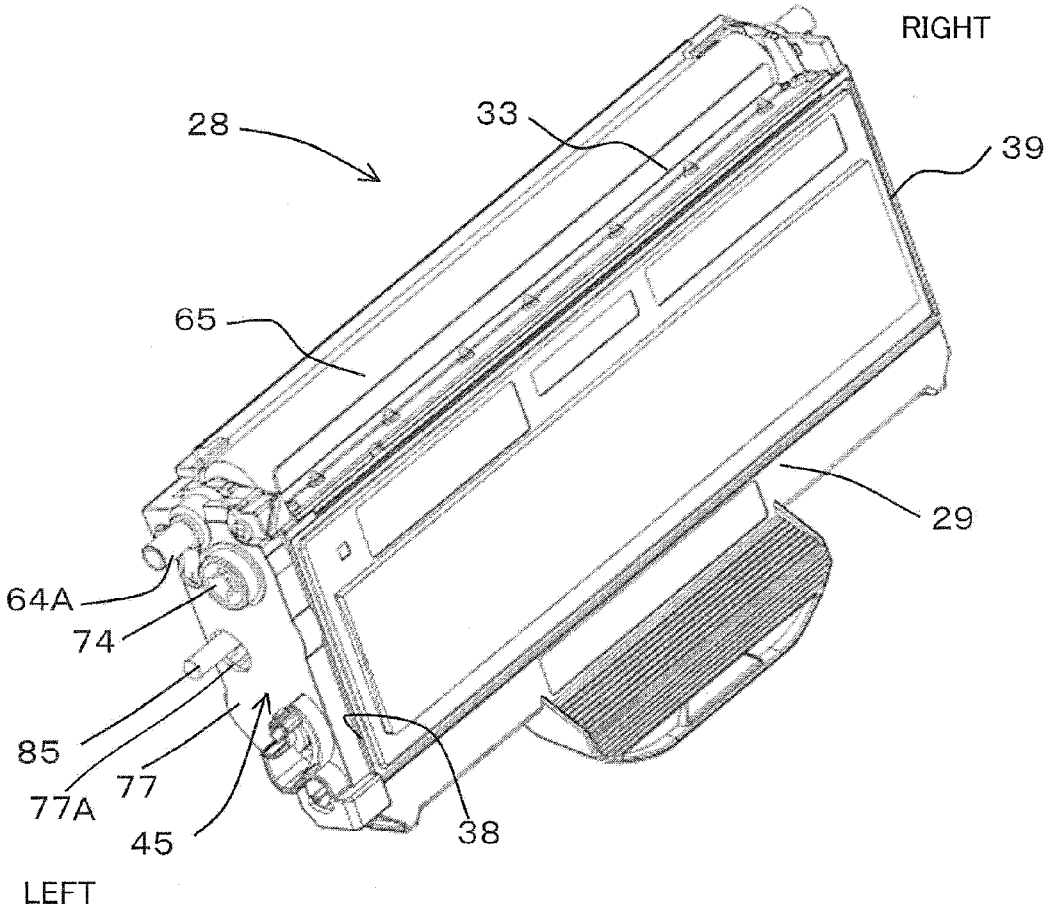
FIG. 6 is a perspective view showing the developing cartridge.

The developing cartridge casing 29 has a boxy shape having five almost-closed sides and one open end where the developing roller 32 is positioned. As shown in FIG. 6, a pair of left and right side plates 38, 39 are provided at lateral positions of the developing cartridge casing 29. The toner chamber 30 is defined between the left and right side plates 38, 39.

Figure 8:
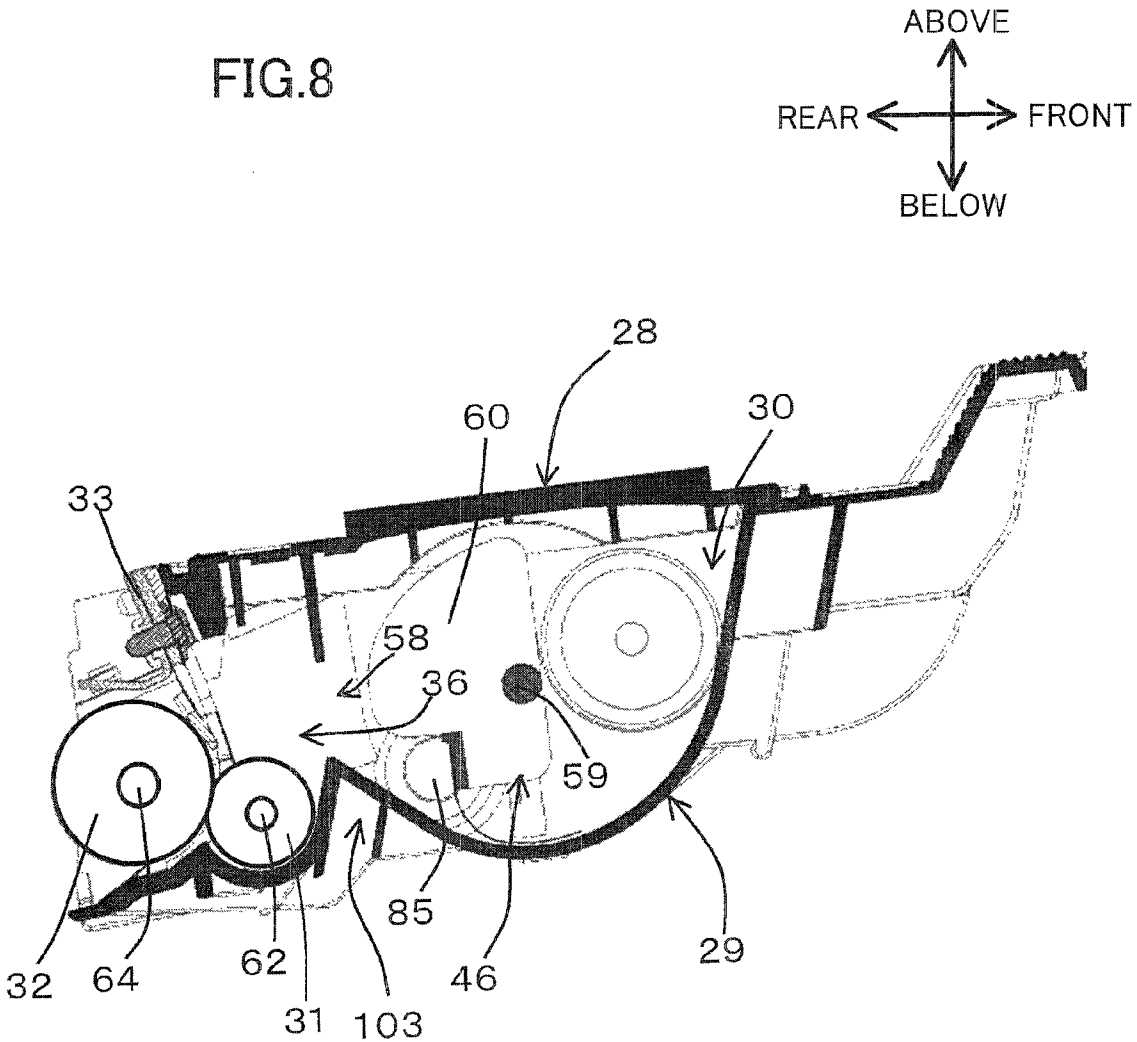
FIG. 8 is a cross-sectional view showing a main part of the developing cartridge.

As shown in FIG. 8, the agitator 46 is provided at a center portion of the toner chamber 30 when viewing from the lateral side of the developing cartridge casing 29. The agitator 46 includes a rotation shaft 59 whose axial end portions are rotatably supported to the left and right side plates 38, 39, and an agitation blade 60 extending radially outwardly from the rotation shaft 59.

Figure 7:
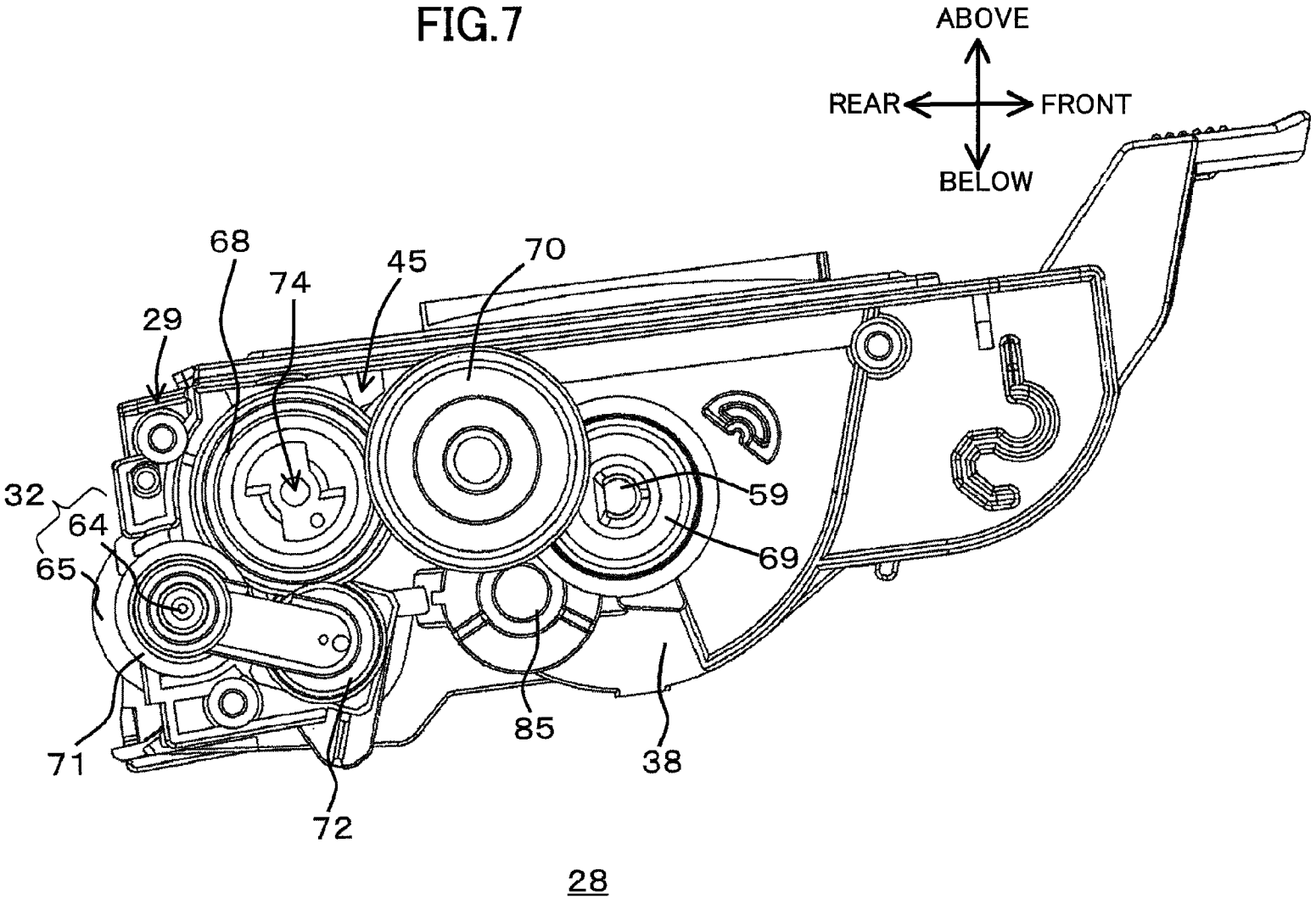
FIG. 7 is a side view showing the developing cartridge with a gear cover removed.

The toner supply roller 31 has a roller shaft 62 protruding laterally outwardly and rotatably supported to the side plates 38, 39. The developing roller 32 has a roller shaft 64 and a roller body 65 formed on the roller shaft 64 (FIG. 7). The roller shaft 64 protrudes laterally outwardly and rotatably supported to the left and right side plates 38, 39. The developing roller 32 is in pressure contact with the toner supply roller 31. A rear part of an outer periphery of the developing roller 32 protrudes outward from the open end of the developing cartridge casing 29.

As shown in FIGS. 5 through 7, a gear transmission mechanism 45 is provided at the left side plate 38 for transmitting driving force to the developing roller 32, the toner supply roller 31, and the agitator 46. A gear cover 77 is fixed to the left side plate 38 for covering the gear transmission mechanism 45. Another gear cover 77 is fixed to the right side plate 39.

As shown in FIG. 7, the gear transmission mechanism 45 includes an input gear 68 and drive gears 69, 71, and 72 directly or indirectly meshingly engaged with the input gear 68. The input gear 68 has a center portion provided with a coupling member 74 exposed through an opening of the gear cover 77 (FIGS. 3 and 5). The coupling member 74 is adapted to be coupled to a main coupling member (not shown) connected to a drive source (not shown) at the main frame 2 when the process cartridge 20 is loaded to the main frame 2 and rotatable together with the rotation of the main coupling member. The drive gear 69 is coaxially fixed to the rotation shaft 59 of the agitator 46, and the drive gear 71 is coaxially fixed to the roller shaft 64 of the developing roller 32. The drive gear 72 is coaxially fixed to the roller shaft 62 of the toner supply roller 31. Thus, the agitator 46, the developing roller 32, and the toner supply roller 31 are rotated upon rotation of the input gear 68.

Each axial end portion of the roller shaft 64 of the developing roller 32 protrudes laterally outward beyond the left or right side plate 38, 39 and rotatably supports a sleeve 64A (FIG. 6) thereon. Each sleeve 64A is supported by the drum cartridge 27 as will be described later.

Figure 10:
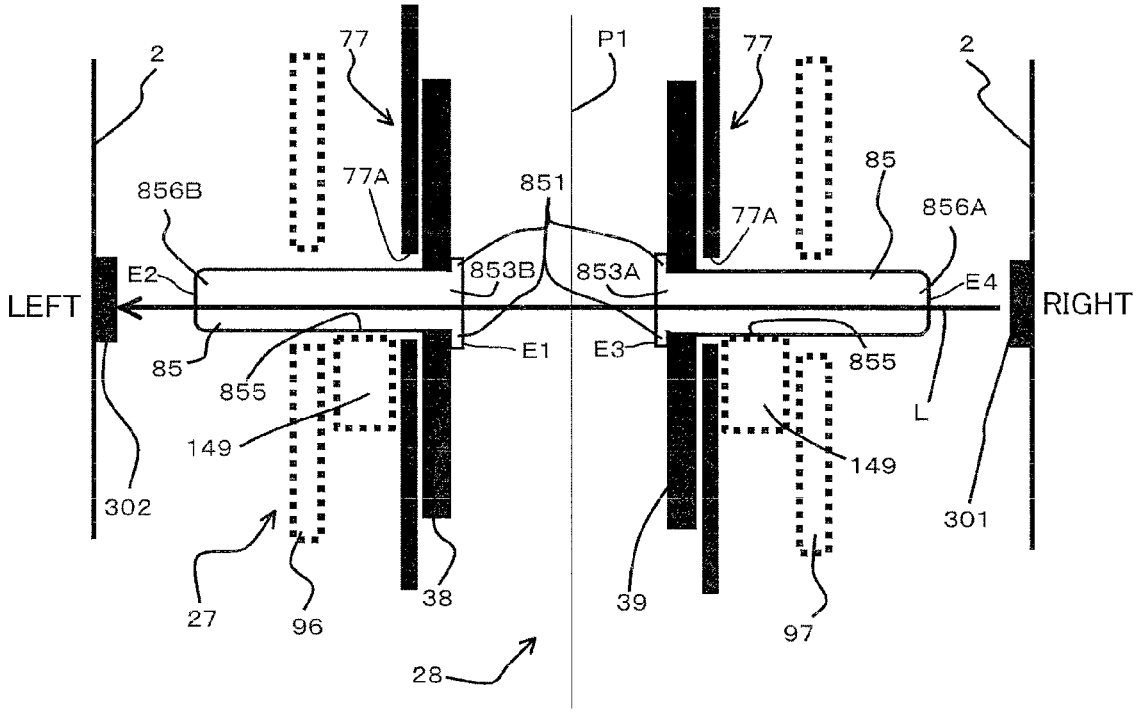
FIG. 10 is an illustrative horizontal cross-sectional view showing light guides of the developing cartridge and surrounding components.

As shown in FIG. 10, light guides 85, 85 are disposed at the left and right side plates 38, 39. The light guides 85 are made from a transparent material and positioned in symmetrical relationship with each other with respect to an imaginary center plane P1 extending perpendicular to the axial direction of the roller shaft 64.

More specifically, each of the left and right side plates 38, 39 is formed with a hole through which each light guide 85 is inserted from the toner chamber 30 side so that the light guide 85 protrudes laterally outward beyond the left or right side plate 38, 39. The light guides 85 have laterally inner end portions 853A, 853B and laterally outer end portions 856A, 856B. The laterally inner end portions 853A, 853B are provided with flanges 851 that are in abutment with and fixed to the left and right side plates 38, 39 by fuse-bonding or an adhesive. The laterally outer end portions 856A, 856B have side surfaces 855, 855 extending in the lateral direction. The side surfaces 855, 855 are adapted to be pressed by pressure members 149 when the developing cartridge 28 is assembled to the drum cartridge 27. Each gear cover 77 has an opening 77A through which each light guide 85 extends outward.

The main frame 2 has a light emitting element 301 and a light receiving element 302. It is preferable that the laterally outer end portions 856A, 856B come into opposition and as close as possible to the light emitting element 301 and the light emitting element 302, respectively, when the process cartridge 20 is loaded to the main frame.

When detecting the residual toner amount, a sensor light L from the light emitting element 301 enters the light guide 85 at the right side plate 37 from the laterally outer end portion 856A and then is directed into the toner chamber 30 through the light guide 85. The sensor light L passed through the toner chamber 30 enters the light guide 85 at the left side plate 36 from the laterally inner end portion 853B and is directed to the light receiving element 302.

The light guide 85 positioned at the left side plate 38 has a length between an inner end E1 and an outer end E2 that is greater than a distance between the inner end E1 and the gear cover 77. Further, the length of the light guide 85 is greater than a distance between the inner end E1 and an outer contour of the gear transmission mechanism 45 on a side of the gear cover 77. With this structure, the outer end E2 can be positioned remote from grease impregnated in the gear transmission mechanism 45.

The drum cartridge 27 has a left side plate 96 and a right side plate 97. The length between the inner end E1 and the outer end E2 is greater than a distance between the inner end E1 and the left side plate 96. Also, a length between an inner end E3 and an outer end E4 is greater than a distance between the inner end E3 and the right side plate 97.

Figure 9:
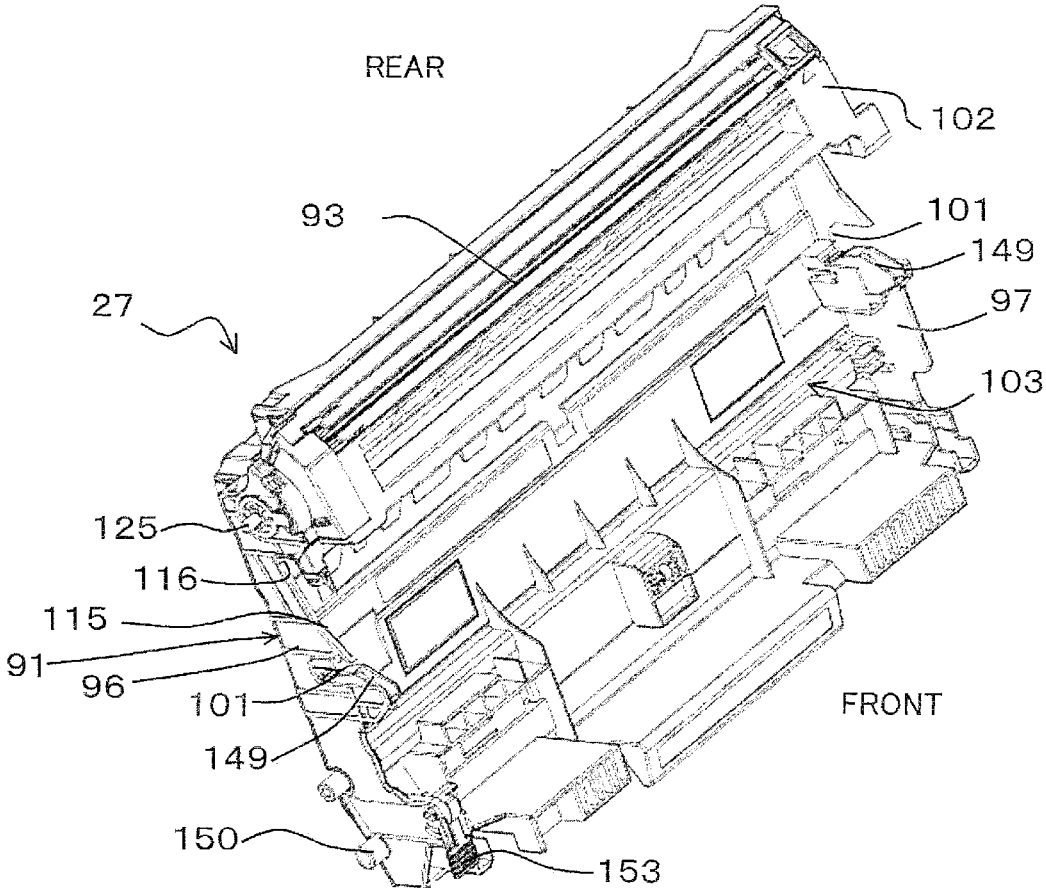
FIG. 9 is a perspective view showing the drum cartridge.

Next, a structure of the drum cartridge 27 will be described in detail with reference to FIGS. 5 and 9. The drum cartridge 27 includes a drum cartridge casing 91 made from a resin such as polystyrene. The drum cartridge casing 91 defines a drum accommodating portion 102 and a developing cartridge accommodating portion 103 those arrayed in the front-to-rear direction. The drum accommodating portion 102 accommodates therein the photosensitive drum 92, the scorotron charger 93, and the transfer roller 94. The drum cartridge casing 91 has a boxy shape having an upper open end through which the developing cartridge 28 is assembled.

The photosensitive drum 92 includes a drum shaft 125 and a drum body (not shown) rotatable about the drum shaft 125. The drum shaft 125 is supported to the left and right side plates 96, 97. The transfer roller 94 is positioned below the photosensitive drum 92 and its rotation shaft (not shown) is rotatably supported to the left and right side plates 96, 97. Each left end portion of each shaft of the photosensitive drum 92 and the transfer roller 94 is integrally fixed with a gear (not shown) meshedly engaged with the gear transmission mechanism 45 at the developing cartridge 28. Thus, the photosensitive drum 92 and the transfer roller 94 are driven by the drive source (not shown) at the main frame 2.

The left and right side plates 96, 97 are formed with a pair of recesses 101. The pair of recesses 101 are aligned with each other in the lateral direction for receiving therein the light guides 85, 85 of the developing cartridge 28. As shown in FIG. 5, each of the recesses 101 is defined by a front surface, a rear surface, a bottom surface, and a top opening. The pressure member 149 is provided along the front surface of each recess 101, and is biased rearward (toward the photosensitive drum 92) by a spring (not shown). Each pressure member 149 has a slant guide surface extending to the bottom of the recess 101.

Each of the left and right side plates 96, 97 is formed with a roller guide 115 and a shaft receiving portion 116 positioned rearward of and contiguous with the roller guide 115. The roller guide 115 and the shaft receiving portion 116 together form a recess like configuration. The roller guide 115 has a guide surface extending toward the drum shaft 125 of the photosensitive drum 92. The roller guide 115 has an upper open end for introducing the sleeve 64A (FIG. 6) of the developing roller 32 into the shaft receiving portion 116 along the guide surface. A lock lever 153 is provided at the drum cartridge casing 91 for locking assembly of the developing cartridge 28 to the drum cartridge 27. Further, the drum cartridge casing 91 is provided with a boss 150, and the main frame 2 has a positioning member 166 (FIG. 1) engageable with the boss 150 for positioning the drum cartridge 27 relative to the main frame 2.

Next, assembling procedure of the developing cartridge 28 to the drum cartridge 27 will be described. As shown in FIG. 5, the developing cartridge 28 is positioned above the developing cartridge accommodating portion 103 of the drum cartridge 27. The sleeves 64A at the end portions of the roller shaft 64 of the developing roller 32 are inserted into the roller guides 115 and guided along the guide surfaces of the roller guides 115 until the sleeves 64A abut rearmost end surfaces of the shaft receiving portions 116.

Then, the developing cartridge 28 is pivotally moved downward about the sleeves 64A, so that a front end portion of the developing cartridge 28 can be positioned into the developing cartridge accommodating portion 103. With this pivotal movement, the light guides 85 are inserted into the recesses 101.

At this time, the side surfaces 855 of the light guides 85 come into abutment with the pressure members 149 and are guided toward the bottoms of the recesses 101 along the slant surfaces of the pressure members 149.

Upon completion of assembly of the developing cartridge 28 into the drum cartridge 27, the pressure members 149 press the side surfaces 855 of the light guides 85 rearward (toward the photosensitive drum 92), so that the developing roller 32 is urged toward the photosensitive drum 92. Therefore, the developing roller 32 can be positioned at a given position with respect to the photosensitive drum 92 in such a manner that the developing roller 32 is in contact with or spaced away from the photosensitive drum 92 by a predetermined distance. Then, the lock lever 153 is operated to lock the position of the developing cartridge 28 relative to the drum cartridge 27. In this case, the left side plates 96 and 38 are facing with each other, and the right side plates 97 and 39 are facing with each other. Further, the light guides 85 are out of contact with the bottom surfaces of the recesses 101.

In this manner, the developing cartridge 28 is assembled to the drum cartridge 27 to provide the process cartridge 20. Upon loading the process cartridge 20 to the main frame 2, the boss 150 is engaged with the positioning member 166 at the main frame 2, thereby positioning the process cartridge 20 relative to the main frame 2 as shown in FIG. 1.

As described above, the pressure members 149 press the side surfaces 855 of the light guides 85 protruding beyond the left and right side plates 38, 39 to urge the developing roller 32 toward the photosensitive drum 92. Since the light guides 85, 85 are positioned symmetrical with each other with respect to the plane P1 extending perpendicular to the axis of the developing roller 32, balanced force in the lateral direction can be applied to the developing roller 32, enabling desirable developing operation.

Next, detection of toner amount remaining in the toner chamber 30 will be described. As shown in FIG. 10, the light emitting element 301 and the light receiving element 302 are disposed in confrontation with each other. A light emitting diode (LED) is used as the light emitting element 301, for example. The light emitting element 301 emits the sensor light L toward the light receiving element 302, and the light receiving element 302 receives the sensor light L. Based on the sensor light L received at the light receiving element 302, the light receiving element 302 outputs an electrical signal having a level corresponding to the amount of sensor light L received at the light receiving element 302. In this embodiment, the light emitting element 301 is disposed in a left-side side wall of the main casing 2 and the light receiving element 302 in a right-side side wall of the main casing 2. However, the light emitting element 301 and the light receiving element 302 may be disposed in reversed relation.

The light emitting element 301, the light guides 85, and the light receiving element 302 are brought into alignment with one another along a line parallel to the axial direction of the roller shaft 64 when the process cartridge 20 is properly positioned with respect to the main casing 2. The remaining toner amount detection is commenced when the laser printer 1 is powered ON or at a predetermining timing, such as, at a time before starting a printing operation.

The sensor light L emitted from the light emitting element 301 enters the light guide 85 at the right side plate 39 from the outer end portion 856A and advances toward the toner chamber 30 while being diffuse-reflected inside the light guide 85.

The sensor light L is then outputted from the inner end portion 853A of the light guide 85 and irradiated into the toner chamber 30. Then, the sensor light L is incident upon the inner end portion 853B of the light guide 85 at the left side plate 38. The sensor light L advances toward the outer end portion 856B of the light guide 85 while being diffuse-reflected inside the light guide 85, and is outputted from the outer end portion 856B of the light guide 85. The light receiving element 302 detects the sensor light L and outputs an electrical signal corresponding to the amount of light received thereat. When a large amount of toner remains in the toner chamber 30, a small amount of light is received at the light receiving element 302. In this case, the light receiving element 302 outputs a low-level electrical signal. Conversely, when a small amount of toner remains in the toner chamber 30, a large amount of light is received at the light receiving element 302. Accordingly, the light receiving element 302 outputs a high-level electrical signal. The amount of toner remaining in the toner chamber 30 can be detected based on the level of the electrical signal.

As described above, the right-side light guide 85 projects beyond the right side plate 97 of the drum cartridge casing 91 toward the light emitting element 301, so that the outer end portion 856A of the light guide 85 is positioned in proximity with the light emitting element 301. The above is also true with respect to the positional relation between the outer end portion 856B of the left-side light guide 85 and the light receiving element 302. Thus, the sensor light L from the light emitting element 301 can effectively reach the light receiving element 302 and can be used for the detection of the toner with no substantial loss of light caused by diffusion. As a result, detection of the remaining toner amount can be accurately performed. Further, because the outer end portion 856B of the light guide 85 projects further outward than the gear transmission mechanism 45, it is unlikely that the outer end portion 856B is polluted by grease scattering from the gears 68, 69, 71 and 72 of the gear transmission mechanism 45, and therefore the sensor light L is substantially free from diffusion.

The light guides 85 are also used as members to be pressed by the pressure members 149 so that the developing roller 32 is urged toward the photosensitive drum 92. It is therefore not necessary to separately provide members to be pressed by the pressure members 149 and to preserve space for such members, thereby preventing the developing cartridge 28 from being large-sized.

Next, a second embodiment of the invention will be described. The second embodiment pertains to a process cartridge to which the present invention is applied. It is to be noted that like parts or like portions as those in the first embodiment are designated by like reference numerals, and duplicate description is omitted with respect to the arrangement same as that described with reference to the first embodiment.

Figure 11:
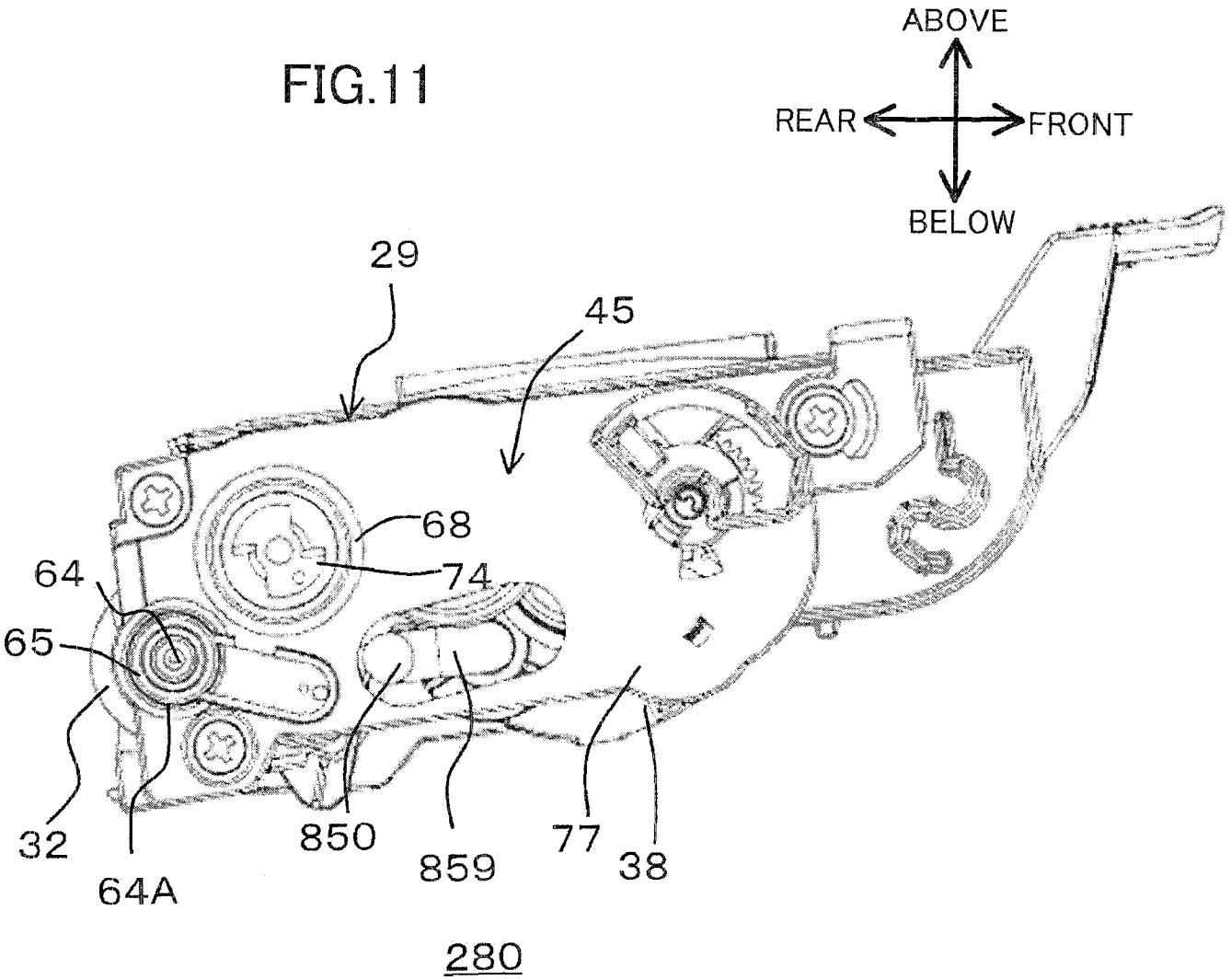
FIG. 11 is a side view showing a developing cartridge according to a second embodiment of the invention.
Figure 12:
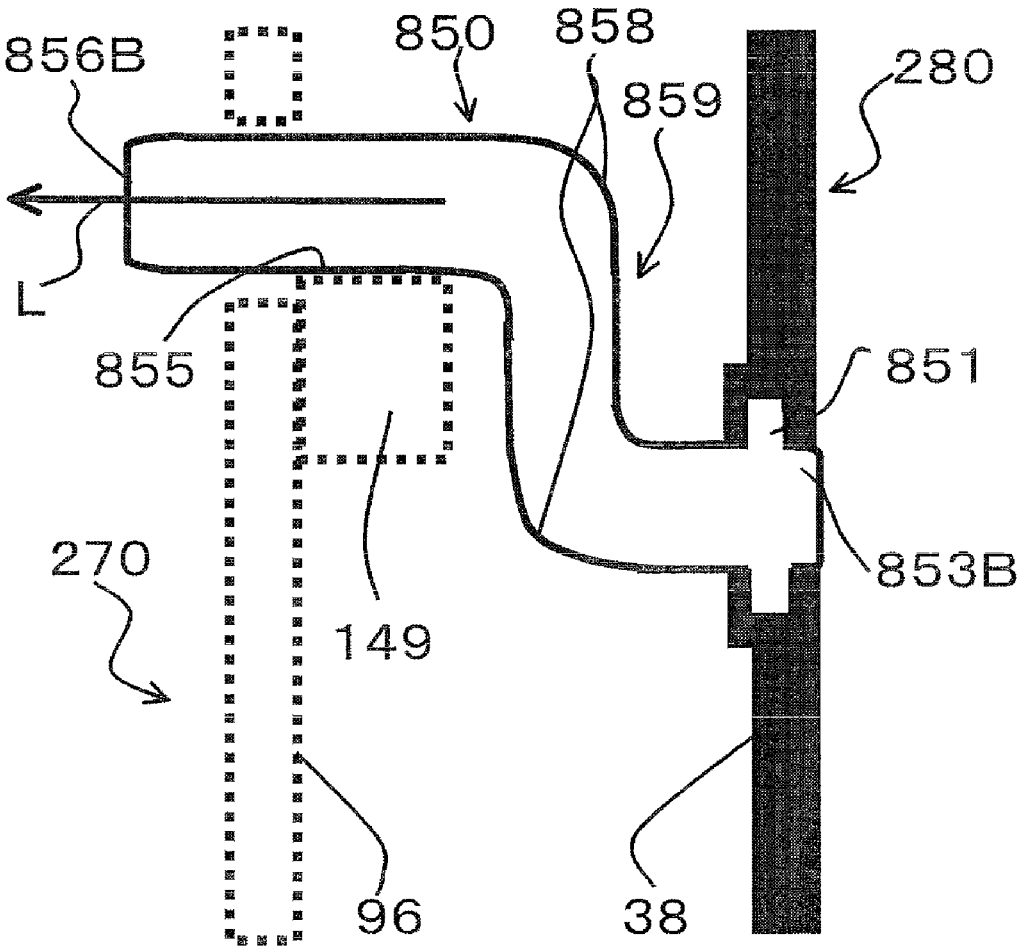

A developing cartridge 280 shown in FIGS. 11 and 12 differs from the developing cartridge 28 of the first embodiment in the shape of light guides. More specifically, the developing cartridge 280 of the second embodiment includes a pair of light guides 850 (only one light guide 850 on the left side is shown in FIG. 12) positioned in symmetrical relationship with each other with respect to the plane P1 (FIG. 10).

Each light guide 850 is right-angled at two portions. For the sake of explanation, the light guide 850 will be described while dividing it into three portions including a first portion extending parallel to the roller shaft 64 of the developing roller 32 and including the inner end portion 853B, a second portion extending parallel to the roller shaft 64 of the developing roller 32 and including the outer end portion 856B, and a third portion 859 extending in a direction substantially orthogonal to the first and second portions. The third portion 859 has smoothly curved portions 858 each for joining the third portion 859 with either the first portion or the second portion. The first portion of the light guide 850 penetrates in part into either the left or right side plate 38, 39 at a right angle with respect thereto and is fixed thereto.

With the above-described shape of the light guide 850, the sensor light L entered the light guide 850 can pass through the light guide 850 without being refracted outside the light guide 850 at the curved portions 858. The inner end portions 853A, 853B of the light guides 850 are in confrontation with each other and arranged on a line parallel to the roller shaft 64 of the developing roller 32.

The light guides 850 may be fixed to the left and right side plates 38, 39 during the production of the left and right side plates 38, 39 by, for example, burying extended head portions 851 into the left and right side plates 38, 39.

In a drum cartridge 270 of the second embodiment, the outer end portion 856A, 856B of each light guide 850 is positioned closer to the developing roller 32 than the inner end portion 853A, 853B. As such, the pressure members 149 and the recesses 101 are provided in positions closer to the photosensitive drum 92 as compared with the drum cartridge 27 of the first embodiment. Each pressure member 149 urges the side surface 855 near the outer end portion 856A, 856B of each light guide 850. The side surface 855 extends in an axial direction of the roller shaft 64. That is, the position in which the light guide 850 is pressed is closer to the photosensitive drum 92 than the position in which the light guide 85 is pressed.

The bending direction of the light guides 850 may be determined arbitrarily, and the positions in which the light guides 850 are pressed by the pressure members 147 may be freely changed. Further, a position of the toner chamber 30 at which the sensor light L enters or is outputted from the toner chamber 30 can also be freely changed. Accordingly, there is no limitation in arranging the light emitting element 301 and the light receiving element 302 within the main frame 2, and thus the design choice of the laser printer can be improved.

Figure 13:
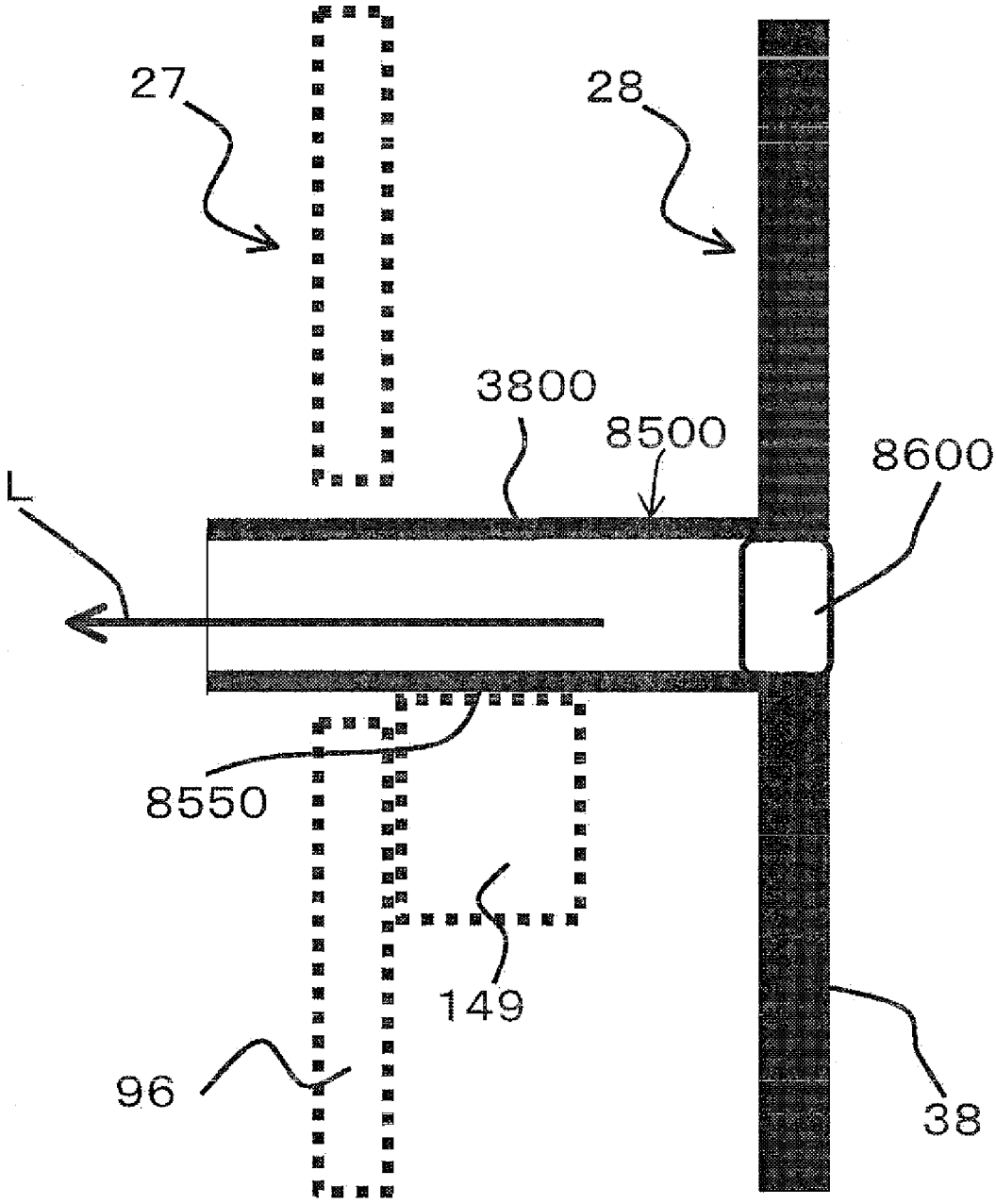

Next, a third embodiment of the invention will be described with reference to FIG. 13. A developing cartridge 2800 of the third embodiment includes a pair of light guides 8500 (only one light guide 8500 on the left side is shown in FIG. 13) positioned in symmetrical relationship with each other with respect to the plane P1 (FIG. 10). Each light guide 8500 includes a window 8600 made from a transparent material and a hollow cylindrical projection 3800 projecting outward from either the left or right side plate 38, 39. The window 8600 is fitted into a through-hole formed in the left or right side plate 38, 39. The projection 3800 surrounds an outer part of an outer periphery of the window 8600.

Similar to the light guide 85 described with reference to the first embodiment, the projection 3800 projects outward beyond both the gear cover 77 and the left or right side plate 96, 97. The projection 3800 has a side surface 8550 extending in a direction parallel to the roller shaft 64 of the developing roller 32. The side surface 8550 is pressed by the pressure member 149 of the drum cartridge 27.

At the time of detection of the residual toner amount, the sensor light L emitted from the light emitting element 301 passes through the projection 3800 and the window 8600 of the light guide 8500 on the right side, the toner chamber 30, and the window 8600 and the projection 3800 of the light guide 8500 on the left side, and is received at the light receiving element 302.

Surrounding the outer periphery of the window 8600, the projection 3800 prevents grease scattered from the gear transmission mechanism 45 from clinging onto the window 8600. Hence., toner amount detecting accuracy is not degraded by the foreign matter clinging to the window 8600. Further, the sensor light L passes through the projection 3800 while being reflected inside the projection 3800 so that the leakage of the sensor light L is not likely to occur. With the structure described above, highly accurate toner amount detection can be performed. Similar to the first and second embodiments, it is not necessary to provide a separate member to be pressed by the pressure member 149 because the projection 3800 plays a role of such a member.

While the invention has been described in detail and with reference to specific embodiments thereof, it would be apparent to those skilled in the art that various changes and modifications may be made without departing from the spirit and scope of the invention.

For example, although the gear transmission mechanism 45 is only provided at the left side plate 38 in the above described embodiments, the gear transmission mechanism 45 may be provided at both the left and right side plates 38 and 39.

What is claimed is:

1. A process cartridge detachably installable to a main frame of an image forming device, the main frame having a developing-agent amount detection unit including a light emitting element and a light receiving element, comprising:

an image bearing member cartridge including:

a first casing having a pair of first and second side plates defining an accommodation portion;

a latent image bearing member having a surface on which an electrostatic latent image is formed, the latent image bearing member being supported to the first casing; and a pressure member; and a developing cartridge detachably installed in the accommodation portion and including:

a second casing having a pair of third and fourth side plates in confrontation with the first and second side plates, respectively, the pair of third and fourth side plates defining a chamber that stores a developing agent;

a developing agent bearing member rotatably supported to the second casing, the developing agent bearing member supplying the developing agent onto the latent image bearing member; and a pair of first and second light guides fixed to the third and fourth side plates, respectively, the pair of first and second light guides being configured to introduce a light emitted from the light emitting element into the chamber and to direct the light from the chamber toward the light receiving element, each of the first and second light guides having a fixed end portion having a first end surface and fixed to either of the third and fourth side plates, a free end portion having a second end surface and remote from the chamber, and a side surface extending in an axial direction of the developing agent bearing member, wherein:

the pressure member presses the side surfaces, thereby urging the developing agent bearing member toward the latent image bearing member.

2. The process cartridge according to claim 1, wherein:

the developing cartridge further includes a gear transmission mechanism provided at the third side plate, the gear transmission mechanism transmitting a driving force to the developing agent bearing member; and a distance between the third side plate and the second end surface of first light guide is greater than a distance between the third side plate and an outer contour of the gear transmission mechanism.

3. The process cartridge according to claim 1, wherein the pair of first and second light guides are made from a transparent material.

4. The process cartridge according to claim 1, wherein the pair of first and second light guides are positioned in symmetrical relationship with each other with respect to a plane extending in a direction perpendicular to the axial direction of the developing agent bearing member.

5. The process cartridge according to claim 1, wherein each of the first and second light guides is bent and has a part that extends in a direction parallel to the second side plates.

6. The process cartridge according to claim 1, wherein each of the first and second light guides includes a window disposed at either of the third and fourth side plates and a hollow cylindrical projection projecting from the either of the third and fourth side plates and surrounding an outer periphery of the window, the hollow cylindrical projection having the side surface.

7. The process cartridge according to claim 1, wherein each of the first and second side plates is formed with a recess having a top opening, the recess receiving therein either of the first and the second light guides.

8. The process cartridge according to claim 1, wherein a distance between the third side plate and the second end surface of the first light guide is greater than a distance between the third side plate and the first side plate.

9. A developing cartridge detachably installable in an image bearing member cartridge including a pressure member, comprising:

a cartridge casing having a pair of first and second side plates defining a chamber that stores a developing agent;

a developing agent bearing member bearing the developing agent supplied from the chamber, the developing agent bearing member rotatably supported to the cartridge casing; and a pair of first and second light guides fixed to the first and second side plates, respectively, the pair of first and second light guides being configured to introduce a light into the chamber and directing the light from the chamber, wherein:

the first light guide has a fixed end portion fixed to the first side plate and a free end portion remote from the chamber;

the free end portion has an end surface and a side surface that the pressure member of the image bearing member cartridge presses, wherein each of the first and second light guides includes a window disposed at either of the first and second side plates and a hollow cylindrical projection projecting from the either of the first and second side plates and surrounding an outer periphery of the window, the hollow cylindrical projection having the side surface.

10. The developing cartridge according to claim 9, further comprising a gear transmission mechanism provided at the first side plate, the gear transmission mechanism transmitting a driving force to the developing agent bearing member, wherein a distance between the first side plate and the end surface is greater than a distance between the first side plate and an outer contour of the gear transmission mechanism.

11. The developing cartridge according to claim 9, wherein the pair of first and second light guides are made from a transparent material.

12. The developing cartridge according to claim 9, wherein the pair of first and second light guides are positioned in symmetrical relationship with each other with respect to a plane extending in a direction perpendicular to an axial direction of the developing agent bearing member.

13. A developing cartridge detachably installable in the image bearing member cartridge including a pressure member and a latent image bearing member, comprising:

a cartridge casing having a pair of first and second side plates defining a chamber that stores a developing agent;

a developing agent bearing member bearing the developing agent supplied from the chamber, the developing agent bearing member rotatably supported to the cartridge casing;

a gear transmission mechanism provided at the first side plate, the gear transmission mechanism transmitting a driving force to the developing agent bearing member; and a pair of first and second light guides fixed to the first and second side plates, respectively, the pair of first and second light guides being made from a transparent material and configured to introduce a light into the chamber and directing the light from the chamber, the pair of first and second light guides being positioned in symmetrical relationship with each other with respect to a plane extending in a direction perpendicular to an axial direction of the developing agent bearing member, wherein:

the first light guide has a fixed end portion fixed to the first side plate and a free end portion remote from the chamber;

the free end portion has an end surface and a side surface that the pressure member of the image bearing member cartridge presses, the free end being configured to urge the developing agent bearing member toward the latent image bearing member when the pressure member presses the end surface and side surface; and a distance between the first side plate and the end surface is greater than a distance between the first side plate and an outer contour of the gear transmission mechanism.

14. A developing cartridge comprising:

a cartridge casing having a pair of first and second side plates defining a chamber that stores a developing agent;

a developing agent bearing member bearing the developing agent supplied from the chamber, the developing agent bearing member rotatably supported to the cartridge casing; and a pair of first and second light guides fixed to the first and second side plates, respectively, the pair of first and second light guides being configured to introduce a light into the chamber and directing the light from the chamber, wherein:

the first light guide has a fixed end portion fixed to the first side plate and a free end portion remote from the chamber;

the free end portion has an end surface and a side surface, wherein each of the first and second light guides includes a window disposed at either of the first and second side plates and a hollow cylindrical projection projecting from the either of the first and second side plates and surrounding an outer periphery of the window, the hollow cylindrical projection having the side surface.

15. The developing cartridge according to claim 14, further comprising a gear transmission mechanism provided at the first side plate, the gear transmission mechanism transmitting a driving force to the developing agent bearing member, wherein a distance between the first side plate and the end surface is greater than a distance between the first side plate and an outer contour of the gear transmission mechanism.

16. The developing cartridge according to claim 14, wherein the pair of first and second light guides are made from a transparent material.

17. The developing cartridge according to claim 14, wherein the pair of first and second light guides are positioned in symmetrical relationship with each other with respect to a plane extending in a direction perpendicular to an axial direction of the developing agent bearing member.

* * * * *